US007669300B1

(12) United States Patent
Schiller

(10) Patent No.: US 7,669,300 B1
(45) Date of Patent: Mar. 2, 2010

(54) CURTAIN FASTENER

(75) Inventor: Kenneth Monroe Schiller, New York, NY (US)

(73) Assignee: Monroe Design, Inc., New York, NY (US)

( * ) Notice: Subject to any disclaimer, the term of this patent is extended or adjusted under 35 U.S.C. 154(b) by 588 days.

(21) Appl. No.: 11/482,482

(22) Filed: Jul. 7, 2006

(51) Int. Cl.
*A47H 13/00* (2006.01)

(52) U.S. Cl. ..... 24/716; 16/87 R

(58) Field of Classification Search ..... 4/558, 4/608; 16/87.2, 87.4 R; 24/598.2, 716; 160/123, 160/330, 341, 348
See application file for complete search history.

(56) References Cited

U.S. PATENT DOCUMENTS 1,209,083 A * 12/1916 Wagner ..... 119/866
1,286,273 A * 12/1918 Gariss ..... 70/458
3,471,891 A * 10/1969 Hatchel ..... 16/87.4 R
3,561,037 A * 2/1971 Hatchel ..... 16/87.2
4,277,434 A * 7/1981 Conway ..... 24/598.2
5,787,954 A * 8/1998 Herrera ..... 160/330
6,484,788 B1 * 11/2002 Jerrell et al. ..... 160/330
7,275,727 B2 * 10/2007 Granston et al. ..... 24/598.2

* cited by examiner

*Primary Examiner*—Robert J Sandy
(74) *Attorney, Agent, or Firm*—Loeb & Loeb LLP

(57) ABSTRACT

Fasteners for suspending aperture curtains, such as shower curtains, from a horizontal rod comprise pivotally connected top and bottom members adapted to close and lock through the insertion of a male protrusion on the bottom member into an aperture on the top member.

2 Claims, 7 Drawing Sheets

CURTAIN FASTENER

FIELD OF INVENTION

The present invention relates generally to fasteners for hanging shower curtains or the like from a rod.

BACKGROUND OF THE INVENTION

Curtains, in particular shower curtains, are typically hung from a horizontal rod and secured thereto with plastic or metal rings which encircle the rod and extend through apertures in the curtain. The most common ring designs in use today are of the type illustrated in U.S. Pat. Nos. 5,367,742, 4,308,637, and 1,034,630, the disclosures of which are hereby incorporated by reference. Such rings typically consist of a unitary piece of flexible plastic in a split-ring construction having opposed ends wherein one end forms a male joint member and the other a female joint member which are snapped together the close the ring. Shower curtain rings of that type have several disadvantages Most notably, these rings have proven to be difficult to mount on a rod due to the unitary construction and low flexibility of the plastic materials from which they are made. Further, for some, the joints prove too difficult to close and prone to breaking under the forces required to snap together the male and female members.

In view of the deficiencies of conventional shower curtain rings, it is a primary objective of the present invention to provide curtain rings, and in particular, shower curtain rings, that are simple to use, do not require undue physical force to close, and are not prone to breaking during attachment to a rod and subsequent closure.

SUMMARY OF THE INVENTION

In a primary aspect of the present invention, a fastener is provided for suspending, with like fasteners, a curtain, such as a shower curtain, on a horizontal rod. The fastener generally comprises top and bottom members. The top member has first and second ends and a substantially U-shaped inner contour configured to balance the fastener on a rod of circular cross-section. The second end of the top member has an aperture configured to receive and hold a male joint protrusion. The bottom member comprises a shaft also having a first and second end, the shaft being of suitable dimensions to fit through an aperture in a curtain. The first ends of the top and bottom members together form a hinge pivotally connecting the top and bottom members. The second end of the bottom member includes a male joint protrusion. The second end of the top member comprises a recessed channel adapted to receive a portion of the second end of the bottom member, including the male joint protrusion, and guide the male joint protrusion through the aperture in the second end of the top member, thereby reversibly closing the fastener.

These and other features and advantages of this invention will become further apparent from the detailed description and accompanying figures that follow. In the figures and description, numerals indicate the various features of the invention, like numerals referring to like features throughout both the drawings and the description.

DETAILED DESCRIPTION

The fasteners of the invention are configured to suspend a curtain, preferably a shower curtain, from a horizontal rod. The fasteners may be used with any conventional shower curtain having a plurality apertures, such as silts or holes, along its a top edge.

Figure 1:
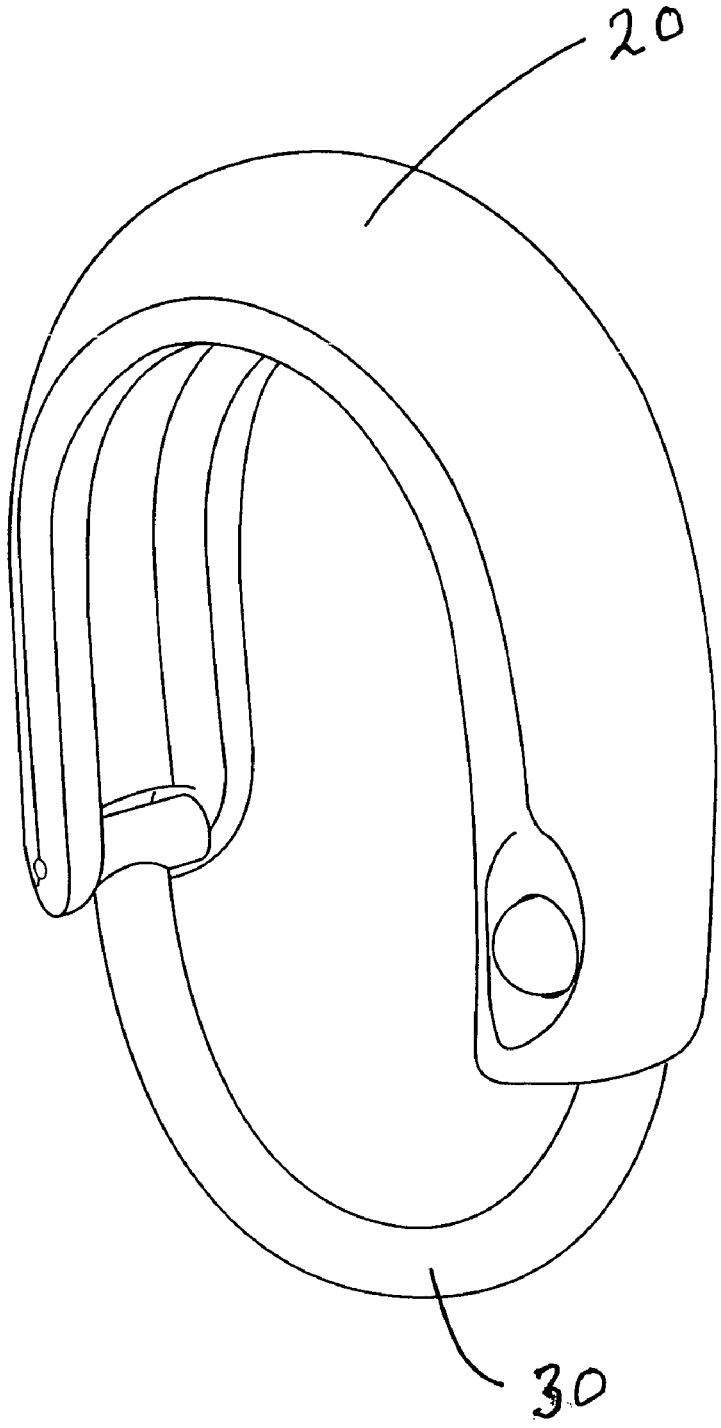
FIG. 1 is a perspective view of a representative fastener in its locked state.

Referring now to FIG. 1, the fastener comprises a top member 20 and a bottom member 30. Top member 20 preferably has a substantially U-shaped inner contour, allowing the fastener to rest stably on top of a horizontal rod, advantageously without need for the user to hold it in place. As used herein, the term "inner contour" refers to contour of top member 20 proximate the rod when the fastener is balanced on a horizontal rod. As also used herein, the term "substantially U-shaped" is not meant to be particularly limiting and includes, for example, horse-shoe and arched configurations, the important aspect being that the inner contour have a central curved region roughly approximating the curvature of the rod and opposed regions of relative straightness projecting below the rod. There is no particular restriction on the shape of the outer contour of top member 20, however, it should preferably be constructed to provide adequate balance such that the fastener will balance on a horizontal rod. In the embodiment illustrated in FIG. 1, both the inner and outer contours of top member 20 are substantially U-shaped.

Figure 2:
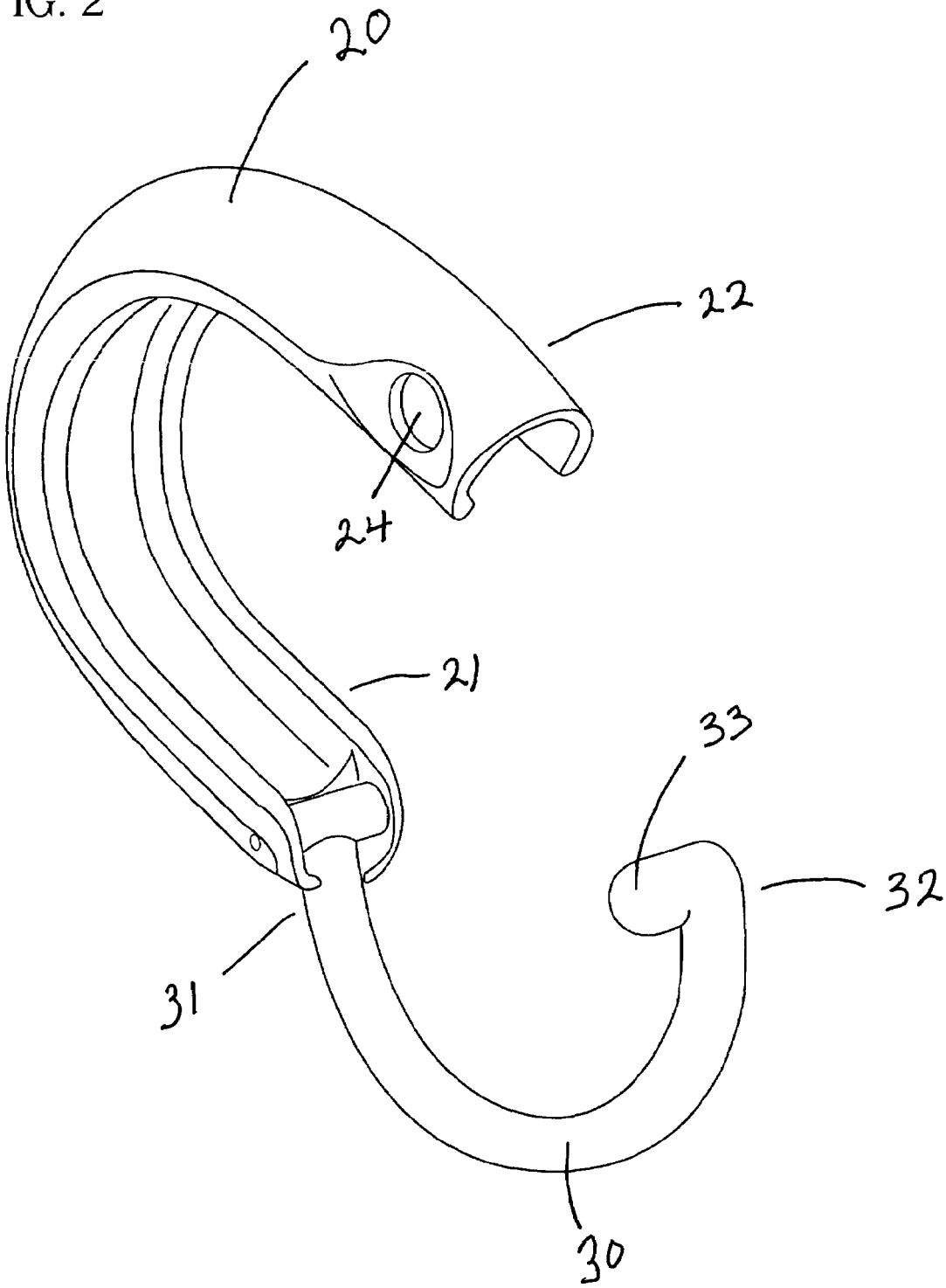
FIG. 2 is a perspective view of a representative fastener in its unlocked state.
Figure 3:
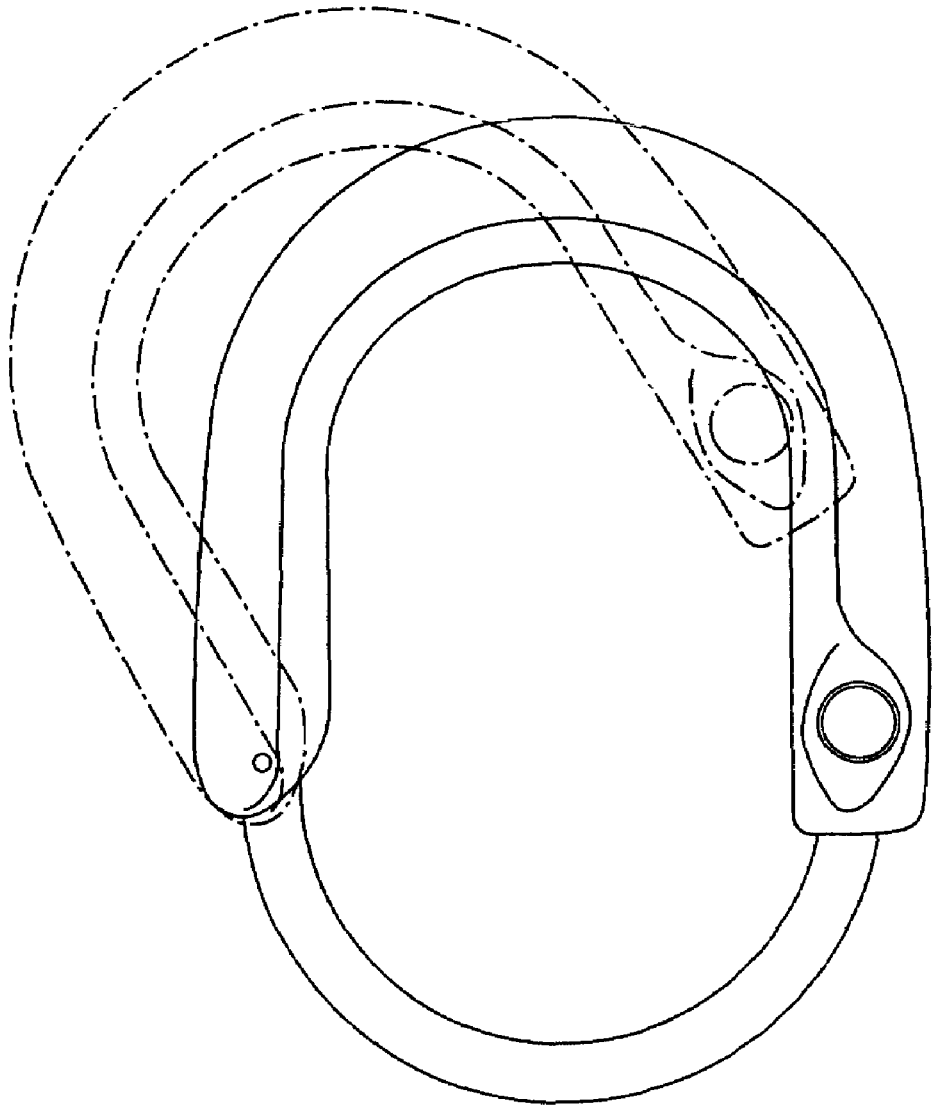
FIG. 3 is a side view of a representative fastener illustrating a pivot about the hinge.

As illustrated in FIG. 2, top member 20 has first and second ends, 21 and 22, respectively. Second end 22 has an aperture 24, preferably circular, on one side. The aperture is configured to receive and hold a male joint protrusion. Bottom member 30 comprises a preferably arch-shaped shaft having first and second ends 31 and 32, respectively. The cross-section of the shaft is of suitable dimensions to engage an aperture in the curtain. The first ends, 21 and 31, of top and bottom members 20 and 30 together form a hinge pivotally connecting the top and bottom members. There is no particular limitation on the type of hinge, which may be without limitation, a knuckle joint, piano hinge, hook-and-eye hinge, and the like. The second end 32 of bottom member 30 includes a male joint protrusion 33 approximately perpendicular to the shaft and extending in the direction of aperture 24. FIG. 3 illustrates the pivoting action about the hinge.

Figure 4:
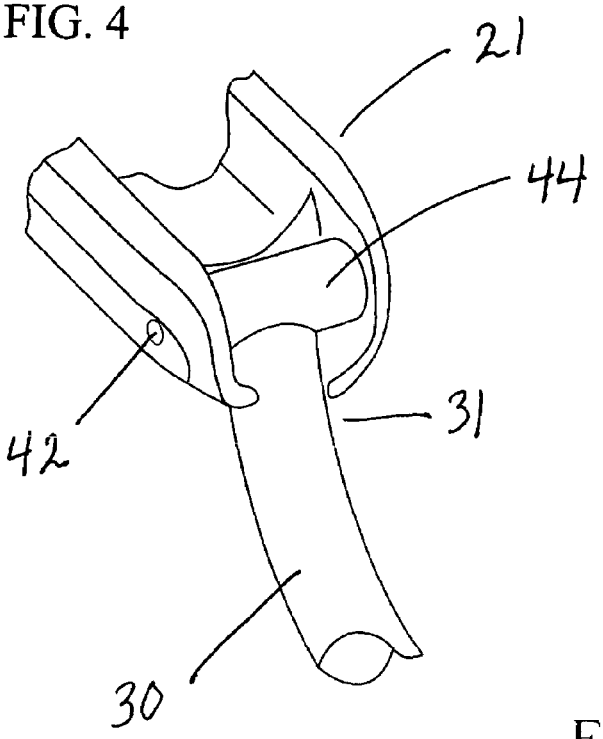
FIG. 4 is a view of the of the hinge portion of a representative fastener.

Referring now to FIG. 4, an exploded view of a currently preferred hinge is provided. First end 31 of bottom member 30 includes a cylindrical member 44 approximately perpendicular to the shaft and having a bore through which hinge pin 42 is disposed. The entire hinge may be located within a channeled recess in top member 20 to improve the overall aesthetics of the fastener.

Figure 5:
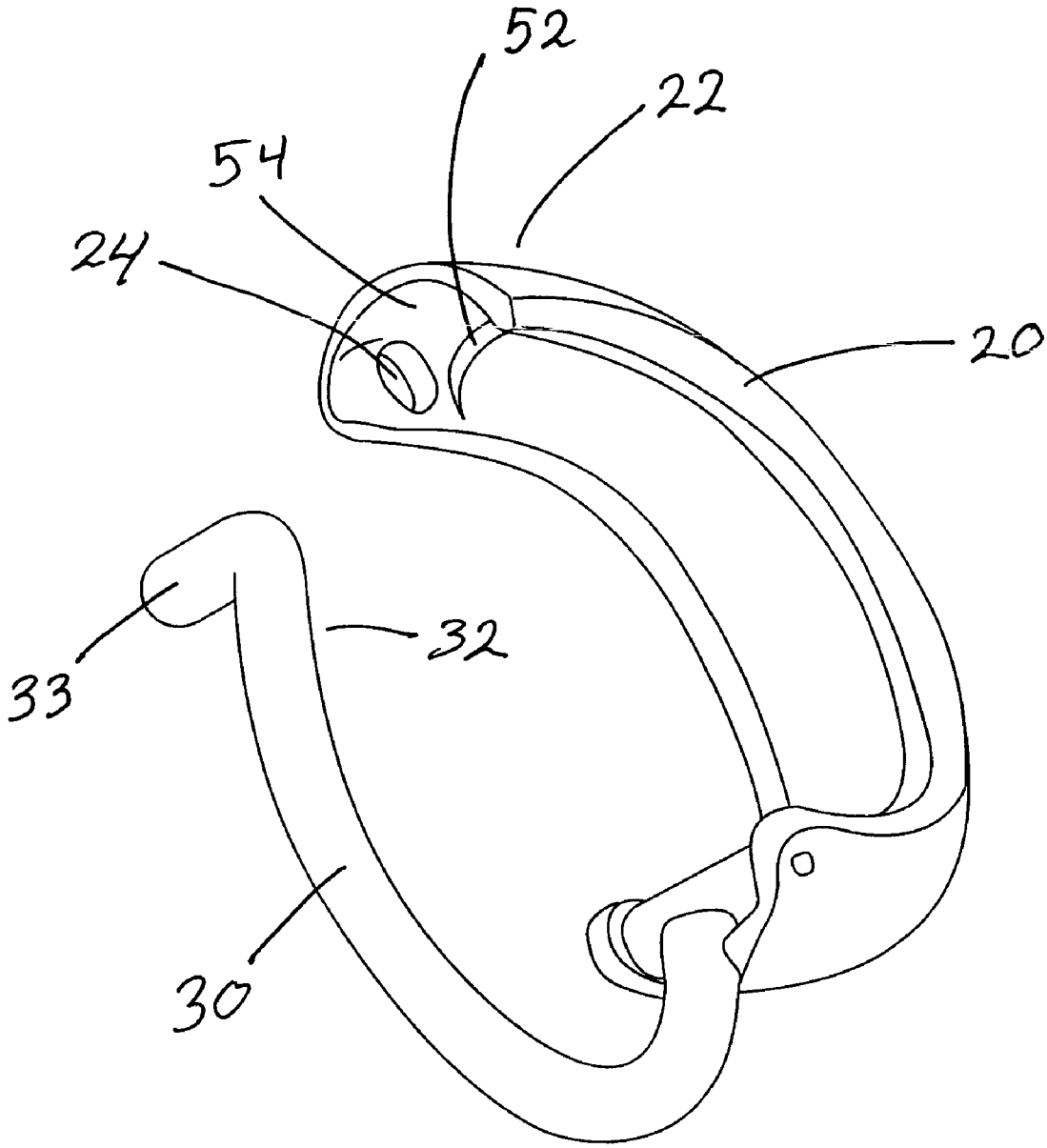
FIG. 5 is another perspective view of a representative fastener in its unlocked state.

Referring to FIG. 5, aspects of a preferred fastener in the unlocked state are illustrated. As shown, second end 22 of top member 20 comprises a recessed channel 54 adapted to receive second end 32 of bottom member 30, including male joint protrusion 33.

Figure 6:
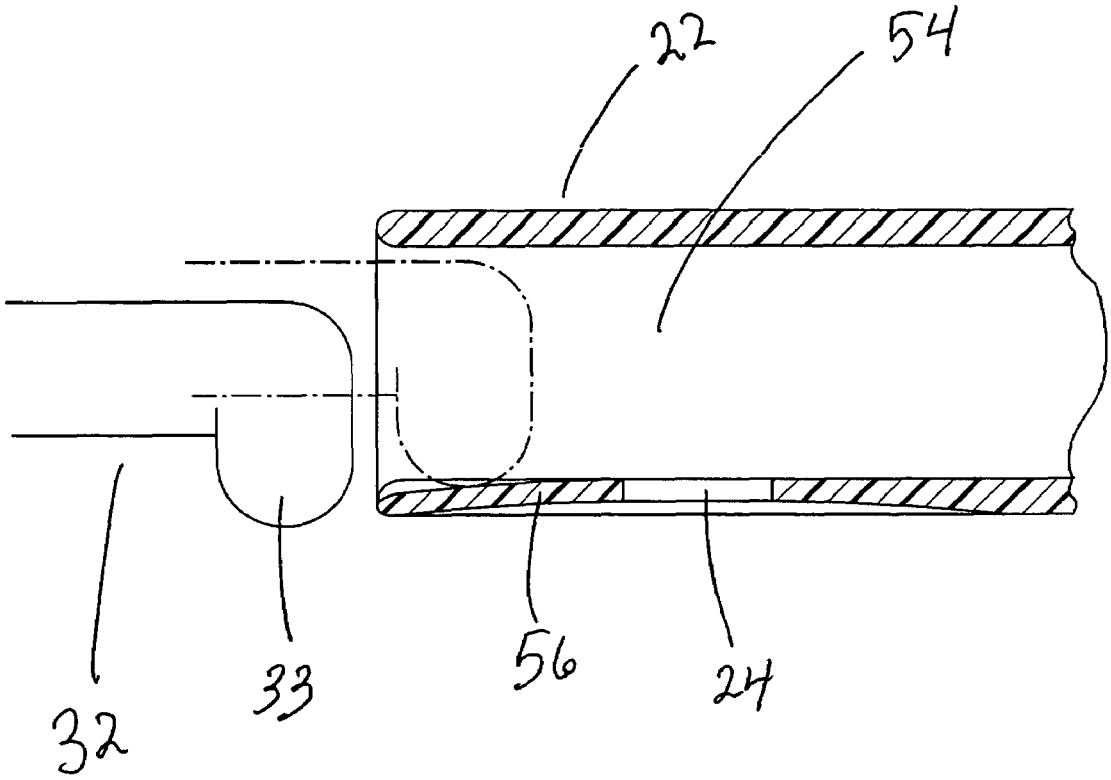
FIG. 6 is a cross-sectional view of the of the second end of a representative top member illustrating the movement of the second end of the bottom member along the beveled inner wall of the top member.

As illustrated in FIG. 6, the wall 56 of recessed channel 54 adjacent aperture 24 on the second end 22 of top member 20 is preferably configured to have a bevel such that during closing of the fastener second end 32 of bottom member 30 is forced inwardly with respect to recessed channel 54 (until male joint protrusion 33 encounters aperture 24 and passes therethrough. This can be accomplished, for example, by configuring the interior wall 56 between aperture 24 and the terminus of second end 32 to curve or bend outwardly from the aperture in a direction away from the interior of the recessed channel (i.e., away from the plane comprising lines 4*a* and 4*b* shown in FIG. 8).

Figure 7:
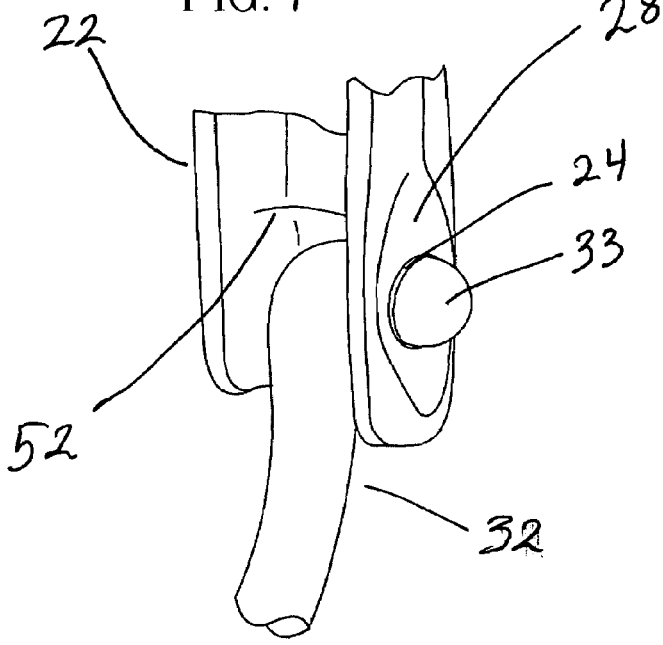
FIG. 7 is a view of the locked ends of a representative fastener.

A view of locked ends 22 and 32 is illustrated in FIG. 7. As shown male joint protrusion 33 extends through aperture 24 when the fastener is closed. Ridge 52, also shown in FIG. 5, may be provided to prevent male joint protrusion 33 from overshooting aperture 24 during closing. In this manner, the fastener closes and locks without the user having to guide the male joint through the aperture, allowing the fastener to be closed with only one hand. The fastener is opened by applying slight inward pressure on male joint protrusion 33 while pulling downward on bottom member 30. A slight recess 28 may be formed on the surface of member 20 surrounding aperture 24 to increase the exposed area of male joint protrusion 33, thereby facilitating opening by accommodating the users thumb.

Figure 8:
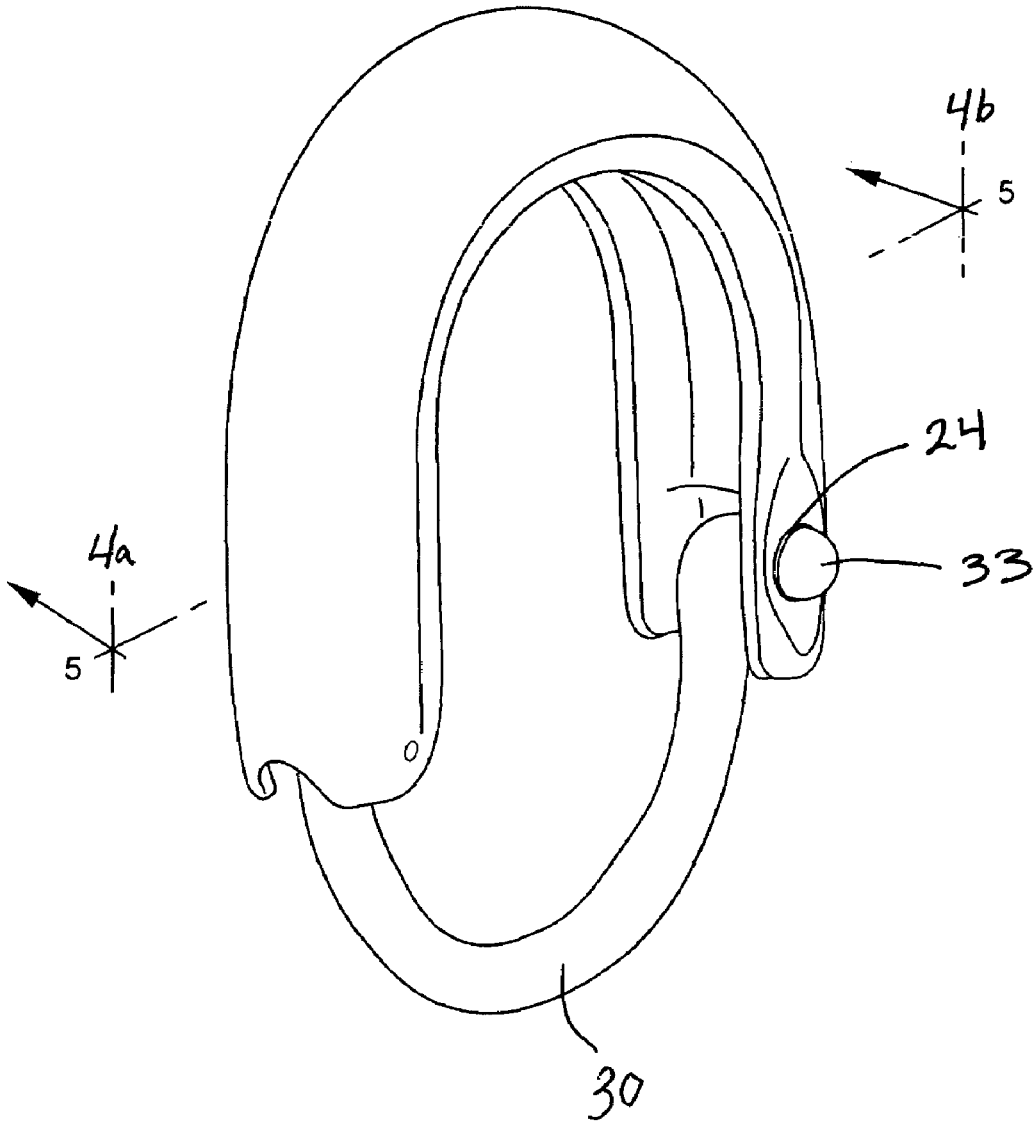
FIG. 8 shows a perspective view of the front of a representative fastener in the locked state.

FIG. 8 illustrates an embodiment of the inventive fasteners in the locked state. Bottom member 30 or a portion thereof may be configured to be bent slightly away from line 5 in the direction of aperture 24 (i.e., displaced from the plane comprising lines 4*a* and 4*b* which approximately bisects the recessed channel 54), such that second end 32 is not exactly aligned with recessed channel 54, but rather is slightly displaced in the direction of aperture 24. This configuration is illustrated in FIG. 6. In this configuration, while the male joint protrusion is engaged with wall 56 during closing of the fastener, some force is exerted against the wall, thereby allowing the male joint protrusion 33 to snap into aperture 24 without the user having to guide it through. A small amount of transverse force may also be present to hold male joint protrusion 33 firmly in aperture 24 in the locked state.

The manner of closing and opening represents an improvement over curtain rings having an "overlapping" locking mechanism, such as those described in U.S. Design Pat. No. D439,144 to Ho, the entire contents of which is hereby incorporated by reference. In contrast to the shower curtain rings disclosed in Ho, second ends 22 and 32 do not together form an overlapping split-ring in the closed state. It is contemplated that rings having an "overlapping" locking mechanism will suffer the disadvantage that small deformations of the ring will render the locking mechanism inoperable. In the present fasteners, male joint protrusion 33 extends through aperture 24 sufficiently far such that minor deformations are accommodated without sacrificing the integrity of the locking mechanism.

There is no particular limitation on the materials from which top and bottom members 20 and 30 are formed. Preferably, each member comprises a water-resistant or waterproof material, such as plastic. Other suitable materials include, without limitation, aluminum and stainless steel. The top and bottom members may be formed by any technique known in the art, including injection molding and the like.

Because the functional attributes of the fasteners of the invention are achieved through the use of separate top and bottom members, rather than a unitary ring construction, greater leeway it afforded for enhancing decorative elements of the fastener. For example, because the top member is not required to be flexible, it may be formed from a wider range of materials than conventional fasteners, i.e., glass, metal, hard plastics and the like, and may comprise various other outer contours, in addition to the U-shaped outer contour of the illustrative fasteners described herein.

Certain modifications and improvements will occur to those skilled in the art upon a reading of the foregoing description. It should be understood that all such modifications and improvements have been deleted herein for the sake of conciseness and readability but are properly within the scope of the invention as claimed.

The invention claimed is:

1. A fastener, said fastener comprising:

(i) a top member having a substantially U-shaped inner contour, said top member having a first end and a second end; said second end having an aperture on one side configured to receive and hold a male joint protrusion; and (ii) a bottom member comprising a shaft having a first end and a second end; said first ends of said top and bottom members together forming a hinge pivotally connecting said top and bottom members; said first end of said bottom member comprises a cylindrical member; said second end of said bottom member comprises a male joint protrusion;

wherein said second end of said top member comprises a recessed channel adapted to receive a portion of said second end of said bottom member including said male joint protrusion and guide said male joint protrusion through said aperture said male joint protrusion and said cylindrical member extend in parallel.

2. The fastener of claim 1, wherein said recessed channel defines on one side a wall comprising said aperture, wherein the portion of said wall between said aperture and the terminus of said second end is configured to force said male joint protrusion inwardly with respect to said recessed channel during closing of the fastener; and further wherein said bottom member is configured such that while said male joint protrusion is engaged with said wall during closing of the fastener, force is exerted against said wall.

* * * * *